US005720920A

United States Patent [19]

Kato et al.

[11] Patent Number: 5,720,920

[45] Date of Patent: Feb. 24, 1998

[54] STEEL HAVING EXCELLENT CORROSION RESISTANCE AND STEEL HAVING EXCELLENT CORROSION RESISTANCE AND WORKABILITY

[75] Inventors: Kenji Kato; Akihiro Miyasaka, both of Tokai, Japan

[73] Assignee: Nippon Steel Corporation, Tokyo, Japan

[21] Appl. No.: 783,472

[22] Filed: Jan. 14, 1997

Related U.S. Application Data

[63] Continuation of Ser. No. 387,922, filed as PCT/JP94/01096, Jul. 6, 1994, abandoned.

[30] Foreign Application Priority Data

Jul. 6, 1993 [JP] Japan ..... 5-167206
Jul. 6, 1993 [JP] Japan ..... 5-167207

[51] Int. Cl.[6] ..... C22C 38/06; C22C 38/18

[52] U.S. Cl. ..... 420/103; 420/105; 420/108; 420/109; 420/104; 420/110

[58] Field of Search ..... 420/62, 79, 104, 420/109, 103, 105, 108, 110

[56] References Cited

U.S. PATENT DOCUMENTS 3,594,156 7/1971 Leckie et al. ..... 420/79
3,690,870 9/1972 Williams ..... 420/79
3,698,964 10/1972 Caule et al. .
3,893,849 7/1975 Brickner ..... 420/79
3,909,250 9/1975 Jasper .
4,316,743 2/1982 Kawai et al. .
5,085,829 2/1992 Ishii et al. ..... 420/79

FOREIGN PATENT DOCUMENTS 0443179 8/1991 European Pat. Off. .
2105944 4/1972 France .

*Primary Examiner*—Deborah Yee
*Attorney, Agent, or Firm*—Kenyon & Kenyon

[57] ABSTRACT

The present invention relates to a steel having excellent corrosion resistance and workability and more particularly to a steel having excellent corrosion resistance and workability in an exhaust system of internal combustion engines in, for example, internal combustion engines in automobiles and ships. A steel having excellent corrosion resistance and a steel having excellent corrosion resistance and workability, characterized by comprising Si: not less than 0.01 to less than 1.2%, Mn: 0.1 to 1.5%, Cr: 2.5 to 9.9%, and Al: more than 3.0 to 8.0%, and, reduced to, C: not more than 0.02%, P: not more than 0.03%, S: not more than 0.01%, and N: not more than 0.02%, and further comprising 0.01 to 0.5% in total of Nb, V, Ti, Zr, Ta, and Hf so as to meet a particular conditional formula, or further comprising at least one member selected from Cu, Mo, Sb, Ni, W, rare earth elements, and Ca, with the balance consisting of Fe and unavoidable impurities.

6 Claims, No Drawings

STEEL HAVING EXCELLENT CORROSION RESISTANCE AND STEEL HAVING EXCELLENT CORROSION RESISTANCE AND WORKABILITY

This application is a continuation of application Ser. No. 08/387,922 filed Feb. 21, 1995 now abandoned which is a 35 U.S.C. §371 of PCT/JP94/01096 filed Jul. 6, 1994.

TECHNICAL FIELD

The present invention relates to a steel having excellent corrosion resistance and a steel having excellent corrosion resistance and workability. More particularly, the present invention relates to a steel having excellent corrosion resistance in exhaust systems of, for example, internal combustion engines in automobiles and ships and a steel which is excellent in corrosion resistance as well as in workability required for working the steel into components.

PRIOR ART

A steel comprising a common steel plated with aluminum or zinc for the purpose of avoiding internal or external corrosion has hitherto been used in an exhaust system of internal combustion engines including those of automobiles from the viewpoint of preventing the steel from being internally or externally corroded. In order to prevent environmental pollution, however, a catalyst or the like has been provided for exhaust gas purification purposes in an exhaust system, rendering the corrosion resistance of the above plated steel product unsatisfactory. Japanese Unexamined Patent Publication (Kokai) Nos. 63-143240, 63-143241, and 2-156048 and the like disclose steels containing 3 to 12% of Cr for improving the corrosion resistance of a steel substrate in an exhaust system. Prolongation of the period of service and the term of guarantee of vehicles in recent years has led to extensive use of a high grade stainless steel containing Cr in an amount up to about 18% and/or Mo in an exhaust system. Even such a stainless steel often undergoes pitting type local corrosion, and, hence, the corrosion-resistance thereof is not always satisfactory. Further, since the above stainless steel contains large amounts of Cr and Mo, they have poor workability, making it very difficult to produce members having a complicate shape, for examples, those for an exhaust system. This complicates the production process, entailing increased working cost. Furthermore, the above stainless steel cannot be worked into some shapes and, at the same time, brings about increased material cost.

A steel incorporating a certain amount of Cr, which is a representative example of a steel used in the above exhaust system, is likely to unfavorably undergo local corrosion when exposed to an aggressive environment. In order to solve this problem, it is common practice to increase the Cr or Mo content to improving the corrosion resistance.

DISCLOSURE OF THE INVENTION

In view of the above problems, the present invention has been made to provide a steel which has high resistance to aggressive environments in exhaust systems of internal combustion engines and the like and is cost effective, or a steel which has high resistance to aggressive environments in exhaust systems of internal combustion engines and the like and, at the same time, excellent workability and cost effectiveness.

In order to solve the above problems, the present inventors have studied from various viewpoints steels having excellent corrosion resistance under aggressive environments including those of exhaust systems. At the outset, the present inventors studied aggressive environments in exhaust systems and, as a result, found that the corrosion of the exhaust system in the internal combustion engines occurs in an environment in which chlorides, sulfate ions, and the like contained in an exhaust gas are heated to 80° to 150° C. Further, they conducted various studies on means to improve the corrosion resistance of the steel under aggressive environments and, as a result, found that, in contrast to conventional stainless steel, when the Cr content is reduced to 2.5 to 9.9% and Al is added in an amount of more than 3.0 to 8.0%, the resultant steel has excellent corrosion resistance under aggressive environments including those in exhaust systems.

In order to develop a better steel, the present inventors made further studies. As a result, they found that, in the above steel, a reduction in the C and N contents and, at the same time, the addition of Nb, V, Ti, Zr, Ta, and Hf in amounts meeting a particular requirement result in improved corrosion resistance and improved workability. Further, they found that better corrosion resistance can be provided by adding to the above steel at least one member selected from Cu, Mo, Sb, Ni and W and at least one member selected from REM and Ca and, further, Si and Mn are proper as a deoxidizing and strengthening element.

The present invention has been made mainly on the above finding, and the subject matter of the first invention resides in a steel having excellent corrosion resistance, characterized by comprising by weight Si: not less than 0.01 to less than 1.2%, Mn: 0.1 to 1.5%, Cr: 2.5 to 9.9%, and Al: more than 3.0 to 8.0%, and, other elements with the following upper limits:

C: not more than 0.02%,

P: not more than 0.03%,

S: not more than 0.01%, and

N: not more than 0.02%, with the balance consisting of Fe and unavoidable impurities.

The subject matter of the second invention resides in a steel comprising the same ingredients as those constituting the steel of the first invention and as an additional ingredient at least one member selected from, by weight, Cu: 0.05 to 3.0%, Mo: 0.05 to 2.0%, Sb: 0.01 to 0.5%, Ni: 0.01 to 2.0%, and W: 0.05 to 3.0%.

The subject matter of the third invention resides in a steel comprising the same ingredients as those constituting the steel of the first or second invention and as an additional ingredient at least one member selected from, by weight, rare earth element: 0.001 to 0.1%, and Ca: 0.0005 to 0.03%.

The subject matter of the fourth invention resides in a steel having excellent corrosion resistance and workability, characterized by comprising by weight Si: not less than 0.01 to less than 1.2%, Mn: 0.1 to 1.5%, Cr: 2.5 to 9.9%, and Al: more than 3.0 to 8.0%, and, other elements with the following upper limits:

C: not more than 0.02%,

P: not more than 0.03%,

S: not more than 0.01%, and

N: not more than 0.02%, and 0.01 to 0.5% in total of at least one element selected from Nb, V, Ti, Zr, Ta, and Hf, provided that a requirement represented by the following formula is met:

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

with the balance consisting of Fe and unavoidable impurities.

The subject matter of the fifth invention resides in a steel comprising the same ingredients as those constituting the steel of the fourth invention and as an additional ingredient at least one member selected from, by weight, Cu: 0.05 to 3.0%, Mo: 0.05 to 2.0%, Sb: 0.01 to 0.5%, Ni: 0.01 to 2.0%, and W: 0.05 to 3.0%.

The subject matter of the sixth invention resides in a steel comprising the same ingredients as those constituting the steel of the fourth or fifth invention and as an additional ingredient at least one member selected from, by weight, rare earth element: 0.001 to 0.1%, and Ca: 0.0005 to 0.03%.

BEST MODE FOR CARRYING OUT THE INVENTION

The present invention provides a steel member having sufficiently high corrosion resistance to cope with use under a harsh corrosive environment recently found in the above automobile exhaust gas system and a steel member having excellent corrosion resistance and workability. The reason for the limitation of chemical ingredients, which are technical features of the present invention, will now be described in detail.

Si:

Si, when added to a steel having a Cr content of not less than 2.5%, effectively serves as a deoxidizer and a strengthening element. However, when the Si content is less than 0.01%, the deoxidization effect is unsatisfactory. On the other hand, when it is not less than 1.2%, the effect is saturated and, at the same time, the workability is deteriorated. For this reason, the Si content is limited to not less than 0.01 to less than 1.2%.

Mn:

Mn is necessary as a deoxidizer for steel and should be contained in an amount of not less than 0.1%. However, when the Fin content exceeds 2.0%, the effect is saturated and, at the same time, the presence of excessive Mn deteriorates the workability of the steel. For this reason, the upper limit of the Mn content is 1.5%.

Cr:

Cr should be incorporated in an amount of not less than 2.5% for ensuring the corrosion resistance of the steel. The incorporation of Cr in an amount exceeding 9.9% uselessly incurs an increase in cost and, at the same time, deteriorates the workability of the steel. For this reason, the upper content of Cr is 9.9%.

Al:

Al, as with Cr, is an element important to the present invention from the viewpoint of ensuring the corrosion resistance. As described above, when the Al content is not more than 3.0%, the effect of preventing the pitting corrosion is unsatisfactory. On the other hand, when the amount of Al added exceeds 8.0%, the above effect is saturated and, at the same time, the workability of the steel is deteriorated. For this reason, the Al content is limited to more than 3.0 to not more than 8.0%.

C, N:

C and N deteriorate the workability of the steel sheet. Further, C combines with Cr to form a carbide which deteriorates the corrosion resistance of the steel. Further, N deteriorates the toughness of the steel. For this reason, the lower the C and N contents, the better the results, and the upper limits of the C and N contents are both 0.02%.

P:

P, when present in a large amount, deteriorates the toughness. Therefore, the lower the P content, the better the results, and the upper limit of the P content is 0.03%.

S:

S too deteriorates the pitting corrosion resistance when it is present in a large amount. Therefore, the lower the S content, the better the results, and the upper limit of the S content is 0.01%.

Nb, V, Ti, Zr, Ta, Hf, Nb, V, Ti, Zr, Ta, and Hf serve to fix, as a carbide, C and N contained in a high Cr steel, thereby significantly improving the corrosion resistance and the workability. They may be added alone or in combination. However, for the addition of these elements alone or in combination, no effect can be attained when the total amount of the elements added is less than 0.01%. When the total amount exceeds 0.5%, the cost is uselessly increased and, at the same time, a flaw or the like is likely to occur during rolling. For this reason, the upper limit of these element is 0.5%. Further, in order to effectively improve the workability, the total amount of the Nb, V, Ti, Zr, Ta, and Hf added should satisfy a requirement represented by the following formula:

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

The above elements are fundamental ingredients of the steel having excellent corrosion resistance or the steel having excellent corrosion resistance and workability contemplated in the present invention. Further, steels with the following elements being optionally added for the purpose of further improving the properties are also contemplated in the present invention.

Cu:

Cu, when added in an amount of not less than 0.05% to a steel having a Cr content of not less than 2.5% and an Al content exceeding 3.0%, has the effect of improving the resistance to general corrosion. However, when the Cu content exceeds 3.0%, the contemplated effect is saturated and, at the same time, the hot workability of the steel is deteriorated. For this reason, the upper content of Cu is 3.0%.

Mo:

Mo, when added in an amount of not less than 0.05% to a steel having a Cr content of not less than 2.5% and anal content exceeding 3.0%, has the effect of inhibiting the occurrence and growth of pitting. However, when the Mo content exceeds 1.5%, the contemplated effect is saturated and, at the same time, the workability of the steel is deteriorated. For this reason, the upper content of Mo is 1.5%.

Sb:

Sb, when added in an amount of not less than 0.01% to a steel having a Cr content of not less than 2.5% and an Al content exceeding 3.0%, has the effect of improving the resistance to pitting corrosion and general corrosion. However, when the Sb content exceeds 0.5%, the hot workability of the steel is deteriorated. For this reason, the upper content of Sb is 0.5%.

Ni:

Ni, when added in an amount of not less than 0.01% to a steel having a Cr content of not less than 2.5% and anal content exceeding 3.0%, has the effect of preventing the pitting corrosion. However, when the Ni content exceeds 2.0%, the contemplated effect is saturated and, at the same time, the hot workability of the steel is deteriorated. For this reason, the upper content of Ni is 2.0%.

W:

W, when added, in an amount of not less than 0.05%, in combination with other additive elements, to a steel having a Cr content of not less than 2.5% and an Al content exceeding 3.0%, has the effect of significantly inhibiting the occurrence and growth of pitting. However, when the W content exceeds 3.0%, the contemplated effect is saturated and, at the same time, the workability of the steel is deteriorated. For this reason, the upper content of W is 3.0%.

Rare earth elements (REM), Ca:

Rare earth elements and Ca are elements having the effect of improving the hot workability and the pitting corrosion resistance. No satisfactory effect can be attained when the content is less than 0.001% for the rare earth element and less than 0.0005% for Ca. On the other hand, when the content exceeds 0.1% for the rare earth element and 0.03% for Ca, coarse nonmetallic inclusions are formed to unfavorably deteriorate the hot workability and the pitting corrosion resistance. For this reason, the upper limit of the content is 0.1% for the rare earth element and 0.03% for Ca. In the present invention, the term "rare earth element" is intended to mean elements with atomic numbers 57 to 71 (lanthanoids), atomic numbers 89 to 103 (actinoids), and atomic number 39 (Y).

The steel of the present invention, when used in an exhaust system of internal combustion engines, may be first produced in a steel sheet form, formed by means of a press or the like into a predetermined shape, and further worked and welded to provide a product. Alternatively, the steel sheet may be first formed into a steel pipe, for example, a seam welded steel pipe, and then fabricated, welded, or subjected to other steps to provide a product. All the steels having a composition and a combination of elements, including the process, specified in the present invention, are contemplated in the present invention. Further, it is also possible to select the optimal production process by taking into consideration the cost, the production equipment restrictions, and the like, but if another production process is selected, the selected process should not deviate from the scope of the claims of the present invention. Furthermore, the steel of the present invention can be applied to, in addition to an exhaust system of internal combustion engines, various other corrosive environments, such as an environment wherein an aqueous solution containing chlorides, sulfate ions, or the like is exposed to high temperatures or an environment wherein heating and cooling are repeated.

The present invention will now be described in more detail with reference to the following example and comparative examples.

EXAMPLE

Steels comprising ingredients specified in Tables 1 to 9 were prepared by the melt process and subjected to conventional steel sheet production steps, such as hot rolling and cold rolling, to provide 1 mm-thick steel sheets which were then annealed at 850° C. Test pieces having a width of 50 mm and a length of 70 mm were prepared from these steel sheets and applied to a corrosion test. The corrosion test was carried out by immersing a test piece to half the height thereof in an aqueous solution (50 $cm^3$) containing 100 ppm of a sulfate ion, 100 ppm of a chloride ion, and 500 ppm of a bicarbonate ion in the form of an ammonium salt, holding the whole testing container in an atmosphere of 130° C. to completely evaporate and volatilize the testing solution, and repeating the above procedure 20 times. This test is a simulation of corrosive conditions in an automobile exhaust system.

In the results of the corrosion test given in Tables 1, 2, 3, 5, 7, and 9, ⊙ represents that the maximum corrosion depth was not more than 0.10 mm, ○ represents that the maximum corrosion depth was not more than 0.15 mm, and X represents that the maximum corrosion depth exceeded 0.15 mm.

The workability was evaluated based on whether or not cracking occurred in a cup reduction test with a reduction ratio of 1.8.

The test results are also shown in Tables 5, 7, and 9. In the test results for workability given in these tables, ○ represents that the results of the cup reduction test were good, and x represents that cracking occurred in the cup reduction test.

As is apparent from Tables 1, 2, 3, 5, 7, and 9, steel Nos. 1 to 36 of the present invention listed in Tables 1 and 2 and steel Nos. 50 to 86 of the present invention listed in Tables 4, 5, 6, and 7 had good corrosion resistance even in an exhaust gas environment which was a very harsh corrosive environment. Further, steel Nos. 50 to 86 of the present invention listed in Tables 4, 5, 6, and 7 were excellent also in workability. By contrast, steel Nos. 37 to 49 as comparative steels listed in Table 3 had poor corrosion resistance, and steel Nos. 87 to 98 as comparative steels listed in Tables 8 and 9 were poor in corrosion resistance as well as in workability.

TABLE 1

| | | Ingredients, wt. % | | | | | | | | | | | | | | | Max. corrosion |
|---|---|---|---|---|---|---|---|---|---|---|---|---|---|---|---|---|---|
| | No. | C | Si | Mn | P | S | Al | Cr | W | Cu | Mo | Sb | Ni | Ca | REM | N | depth |
| Steel | 1 | 0.011 | 0.12 | 0.21 | 0.015 | 0.005 | 4.15 | 2.6 | | | | | | | | 0.013 | ⊙ |
| of | 2 | 0.008 | 1.02 | 0.41 | 0.017 | 0.007 | 4.08 | 2.6 | 2.99 | 2.28 | 1.7 | 0.29 | 1.7 | 0.019 | | 0.017 | ⊙ |

TABLE 1-continued

| | No. | Ingredients, wt. % | | | | | | | | | | | | | | | Max. corrosion depth |
|---|---|---|---|---|---|---|---|---|---|---|---|---|---|---|---|---|---|
| | | C | Si | Mn | P | S | Al | Cr | W | Cu | Mo | Sb | Ni | Ca | REM | N | |
| invention | 3 | 0.003 | 0.60 | 0.31 | 0.015 | 0.010 | 3.16 | 2.7 | 1.59 | | | | | | | 0.007 | ○ |
| | 4 | 0.014 | 1.14 | 0.23 | 0.010 | 0.008 | 7.40 | 3.0 | | | 0.9 | | | | | 0.015 | ◎ |
| | 5 | 0.008 | 0.39 | 1.41 | 0.010 | 0.008 | 6.37 | 3.0 | | 1.31 | | | 1.6 | | | 0.008 | ◎ |
| | 6 | 0.005 | 1.18 | 1.26 | 0.019 | 0.006 | 3.48 | 3.3 | | | | | 1.0 | | | 0.006 | ○ |
| | 7 | 0.009 | 0.98 | 0.81 | 0.023 | 0.006 | 3.53 | 3.4 | 0.42 | 2.05 | 0.1 | | | 0.026 | | 0.015 | ◎ |
| | 8 | 0.008 | 0.65 | 1.46 | 0.014 | 0.006 | 4.07 | 3.5 | 0.37 | | | 0.28 | | | 0.058 | 0.009 | ○ |
| | 9 | 0.005 | 0.31 | 0.81 | 0.010 | 0.005 | 6.11 | 3.6 | | | | | 0.5 | 0.009 | | 0.008 | ◎ |
| | 10 | 0.020 | 0.67 | 1.49 | 0.019 | 0.004 | 3.17 | 3.6 | 0.80 | 2.01 | 0.7 | 0.18 | | 0.002 | | 0.016 | ◎ |
| | 11 | 0.005 | 0.93 | 1.47 | 0.026 | 0.010 | 5.99 | 3.8 | 1.48 | 1.10 | | | | 0.010 | | 0.011 | ◎ |
| | 12 | 0.014 | 0.52 | 1.13 | 0.020 | 0.004 | 3.51 | 4.0 | | 1.35 | | | | | | 0.009 | ◎ |
| | 13 | 0.003 | 0.67 | 1.01 | 0.023 | 0.007 | 3.06 | 4.1 | 2.88 | 2.30 | 1.1 | | | | | 0.017 | ◎ |
| | 14 | 0.012 | 0.42 | 0.87 | 0.025 | 0.008 | 5.65 | 4.2 | | | | 0.17 | | | | 0.014 | ◎ |
| | 15 | 0.018 | 0.63 | 1.19 | 0.024 | 0.003 | 4.06 | 4.4 | 0.55 | | 0.9 | | | | 0.006 | 0.004 | ◎ |
| | 16 | 0.013 | 0.27 | 0.30 | 0.018 | 0.009 | 4.33 | 4.6 | 0.47 | | | | | | 0.048 | 0.016 | ◎ |
| | 17 | 0.014 | 0.62 | 0.34 | 0.028 | 0.004 | 3.91 | 4.7 | 2.66 | 1.70 | 1.4 | 0.03 | 0.4 | 0.027 | 0.041 | 0.003 | ◎ |
| | 18 | 0.006 | 0.28 | 0.57 | 0.018 | 0.009 | 3.82 | 4.9 | | | 0.6 | | 1.5 | | | 0.009 | ◎ |

TABLE 2

| | No. | Ingredients, wt. % | | | | | | | | | | | | | | | Max. corrosion depth |
|---|---|---|---|---|---|---|---|---|---|---|---|---|---|---|---|---|---|
| | | C | Si | Mn | P | S | Al | Cr | W | Cu | Mo | Sb | Ni | Ca | REM | N | |
| Steel of invention | 19 | 0.007 | 0.92 | 1.14 | 0.016 | 0.008 | 6.39 | 5.3 | | | | | | 0.019 | 0.058 | 0.011 | ◎ |
| | 20 | 0.006 | 0.44 | 0.64 | 0.022 | 0.008 | 6.09 | 5.5 | | 0.83 | 2.0 | 0.07 | 0.9 | | | 0.012 | ◎ |
| | 21 | 0.010 | 0.72 | 0.33 | 0.010 | 0.007 | 4.27 | 5.7 | | | 1.3 | 0.08 | | | | 0.018 | ◎ |
| | 22 | 0.017 | 0.14 | 0.31 | 0.020 | 0.006 | 5.58 | 5.9 | | | | | | | | 0.013 | ◎ |
| | 23 | 0.016 | 1.02 | 0.21 | 0.027 | 0.004 | 3.62 | 6.4 | | 1.35 | 1.5 | 0.44 | | | | 0.013 | ◎ |
| | 24 | 0.008 | 0.63 | 1.19 | 0.025 | 0.003 | 4.09 | 6.8 | | 2.84 | 1.5 | | | | 0.077 | 0.015 | ◎ |
| | 25 | 0.014 | 0.28 | 1.21 | 0.028 | 0.004 | 7.72 | 7.3 | | 1.18 | 0.7 | 0.35 | | | 0.076 | 0.016 | ◎ |
| | 26 | 0.013 | 0.57 | 0.65 | 0.015 | 0.008 | 6.94 | 7.4 | | | | 0.15 | | 0.003 | | 0.008 | ○ |
| | 27 | 0.011 | 0.99 | 0.62 | 0.018 | 0.008 | 4.12 | 7.6 | | 2.05 | 0.5 | | 0.6 | | | 0.017 | ○ |
| | 28 | 0.012 | 0.51 | 1.13 | 0.013 | 0.007 | 5.50 | 7.7 | | | | 0.06 | 1.0 | | | 0.016 | ◎ |
| | 29 | 0.003 | 0.88 | 1.49 | 0.022 | 0.010 | 5.39 | 7.8 | | | | | | | | 0.012 | ○ |
| | 30 | 0.016 | 0.56 | 1.06 | 0.020 | 0.009 | 7.08 | 8.4 | | | | | | | | 0.014 | ◎ |
| | 31 | 0.018 | 0.27 | 1.12 | 0.012 | 0.009 | 4.77 | 8.5 | | 0.99 | | | | | 0.014 | 0.014 | ○ |
| | 32 | 0.018 | 0.81 | 0.90 | 0.024 | 0.009 | 7.82 | 8.6 | | | 1.9 | | | 0.028 | | 0.006 | ◎ |
| | 33 | 0.009 | 0.50 | 0.38 | 0.022 | 0.005 | 4.18 | 9.0 | 1.48 | 0.92 | 0.4 | 0.10 | 1.2 | | 0.092 | 0.011 | ◎ |
| | 34 | 0.012 | 0.13 | 0.97 | 0.016 | 0.008 | 4.62 | 9.4 | | | | | 1.3 | | 0.098 | 0.010 | ◎ |
| | 35 | 0.006 | 0.15 | 0.92 | 0.021 | 0.009 | 4.70 | 9.4 | 0.54 | | | | | 0.013 | | 0.013 | ◎ |
| | 36 | 0.013 | 0.35 | 1.23 | 0.020 | 0.004 | 5.36 | 9.8 | 2.55 | 1.77 | | 0.19 | | | | 0.007 | ◎ |

TABLE 3

| | No. | Ingredients, wt. % | | | | | | | | | | | | | | | Max. corrosion depth |
|---|---|---|---|---|---|---|---|---|---|---|---|---|---|---|---|---|---|
| | | C | Si | Mn | P | S | Al | Cr | W | Cu | Mo | Sb | Ni | Ca | REM | N | |
| Comparative steel | 37 | 0.009 | 0.49 | 0.64 | 0.028 | 0.005 | 0.04 | 7.5 | | | | | | | | 0.011 | X |
| | 38 | 0.005 | 0.45 | 1.09 | 0.026 | 0.003 | 0.25 | 7.3 | 0.08 | | | | | | | 0.003 | X |
| | 39 | 0.016 | 0.49 | 0.73 | 0.028 | 0.004 | 0.21 | 7.5 | 0.15 | | 2.5 | | | | | 0.008 | X |
| | 40 | 0.016 | 0.13 | 0.50 | 0.035 | 0.005 | 0.22 | 9.3 | | | | | | | | 0.013 | X |
| | 41 | 0.020 | 0.15 | 0.41 | 0.032 | 0.007 | 0.29 | 5.2 | | | | | | | 0.032 | 0.008 | X |
| | 42 | 0.014 | 0.14 | 1.21 | 0.031 | 0.005 | 0.03 | 9.8 | | | | | | 0.003 | | 0.011 | X |
| | 43 | 0.010 | 0.18 | 0.68 | 0.038 | 0.004 | 0.29 | 9.3 | | | 2.1 | | | | | 0.005 | X |
| | 44 | 0.045 | 0.21 | 1.18 | 0.037 | 0.006 | 0.04 | 8.6 | | | | 0.32 | | | | 0.006 | X |
| | 45 | 0.013 | 0.29 | 1.27 | 0.032 | 0.005 | 0.22 | 9.2 | | 1.10 | | | | | | 0.007 | X |
| | 46 | 0.013 | 0.18 | 0.69 | 0.039 | 0.003 | 0.03 | 9.8 | | | | | 1.4 | | | 0.006 | X |
| | 47 | 0.020 | 0.45 | 0.70 | 0.037 | 0.006 | 0.21 | 11.5 | | 1.40 | | | | | | 0.006 | X |
| | 48 | 0.017 | 0.47 | 0.87 | 0.045 | 0.003 | 0.30 | 10.5 | 0.80 | 1.20 | | | 1.1 | 0.010 | | 0.010 | X |
| | 49 | 0.010 | 0.51 | 1.04 | 0.037 | 0.005 | 0.05 | 11.8 | 1.10 | 0.41 | 1.5 | 0.05 | 0.4 | | | 0.011 | X |

TABLE 4

| | No. | Ingredients, wt. % | | | | | | | | | | | | |
|---|---|---|---|---|---|---|---|---|---|---|---|---|---|---|
| | | C | Si | Mn | P | S | Al | Cr | W | Nb | V | Ti | Zr | Ta |
| Steel of invention | 50 | 0.016 | 0.31 | 0.72 | 0.012 | 0.010 | 3.62 | 2.7 | | | | 0.08 | | 0.07 |
| | 51 | 0.005 | 0.69 | 1.35 | 0.030 | 0.010 | 6.66 | 2.8 | | | | | | 0.15 |
| | 52 | 0.006 | 0.95 | 1.41 | 0.005 | 0.004 | 5.88 | 2.9 | | | 0.07 | | 0.05 | |
| | 53 | 0.016 | 1.18 | 0.59 | 0.015 | 0.007 | 3.30 | 2.9 | | | 0.07 | 0.02 | | 0.05 |
| | 54 | 0.011 | 0.25 | 0.81 | 0.006 | 0.010 | 5.33 | 2.9 | | 0.08 | 0.05 | | | 0.07 |
| | 55 | 0.015 | 0.68 | 1.47 | 0.029 | 0.009 | 4.69 | 3.0 | | 0.15 | 0.08 | | | |
| | 56 | 0.020 | 0.41 | 0.17 | 0.029 | 0.005 | 3.47 | 3.3 | | | 0.05 | 0.08 | | |
| | 57 | 0.018 | 0.74 | 0.14 | 0.023 | 0.005 | 3.94 | 3.5 | | | 0.22 | | | |
| | 58 | 0.005 | 0.76 | 0.87 | 0.007 | 0.003 | 3.15 | 3.7 | | | | | 0.09 | |
| | 59 | 0.008 | 0.36 | 1.14 | 0.023 | 0.010 | 7.29 | 4.0 | | 0.11 | 0.03 | 0.03 | | 0.07 |
| | 60 | 0.006 | 0.33 | 0.48 | 0.012 | 0.006 | 6.24 | 4.1 | | 0.04 | 0.03 | 0.05 | 0.05 | 0.07 |
| | 61 | 0.016 | 0.82 | 0.81 | 0.014 | 0.003 | 3.90 | 4.2 | | 0.11 | 0.05 | 0.03 | | |
| | 62 | 0.007 | 0.50 | 0.84 | 0.010 | 0.009 | 3.33 | 4.2 | | | | 0.07 | | |
| | 63 | 0.016 | 0.17 | 1.45 | 0.010 | 0.008 | 4.82 | 4.4 | 2.90 | | 0.12 | 0.07 | 0.02 | |
| | 64 | 0.007 | 0.13 | 1.47 | 0.023 | 0.007 | 5.98 | 4.7 | 1.79 | 0.22 | | | | 0.05 |
| | 65 | 0.016 | 0.33 | 0.94 | 0.010 | 0.009 | 3.36 | 4.7 | | 0.18 | | | | |
| | 66 | 0.005 | 0.23 | 0.37 | 0.019 | 0.006 | 3.14 | 5.0 | | | | | 0.09 | 0.07 |
| | 67 | 0.006 | 1.10 | 1.42 | 0.017 | 0.009 | 3.71 | 5.1 | 0.64 | 0.22 | 0.09 | | | |
| | 68 | 0.013 | 0.91 | 0.40 | 0.019 | 0.004 | 3.30 | 5.1 | | 0.15 | 0.02 | 0.03 | | |

TABLE 5

(Continuation of Table 4)

| | No. | Ingredients, wt. % | | | | | | | | X value × 10000 | Workabily | Max. corrosion depth |
|---|---|---|---|---|---|---|---|---|---|---|---|---|
| | | Hf | Cu | Mo | Sb | Ni | Ca | REM | N | | | |
| Steel of invention | 50 | | 1.78 | | | | | 0.058 | 0.007 | 5.97 | ○ | ○ |
| | 51 | 0.22 | | 0.47 | | | | 0.000 | 0.014 | 9.61 | ○ | ◎ |
| | 52 | | 1.20 | 1.60 | | | | | 0.015 | 6.55 | ○ | ○ |
| | 53 | | | | | | 0.008 | 0.073 | 0.005 | 6.86 | ○ | ○ |
| | 54 | | | | 0.13 | | | 0.035 | 0.013 | 7.73 | ○ | ○ |
| | 55 | | 1.21 | | | | | | 0.016 | 12.75 | ○ | ○ |
| | 56 | | | | | | | 0.010 | 0.014 | 5.24 | ○ | ◎ |
| | 57 | 0.09 | 1.05 | | | 1.06 | | | 0.017 | 26.73 | ○ | ◎ |
| | 58 | 0.07 | | 1.84 | | | 0.011 | | 0.015 | 1.80 | ○ | ○ |
| | 59 | | 2.97 | 1.35 | 0.21 | | 0.016 | | 0.013 | 15.12 | ○ | ◎ |
| | 60 | | 1.44 | 0.20 | 0.39 | 1.63 | 0.010 | | 0.009 | 20.81 | ○ | ◎ |
| | 61 | | | | 0.14 | 1.25 | | | 0.020 | 4.90 | ○ | ○ |
| | 62 | 0.17 | | 0.49 | 0.44 | | | | 0.010 | 13.71 | ○ | ○ |
| | 63 | | | | | 1.22 | | 0.065 | 0.019 | 18.55 | ○ | ◎ |
| | 64 | | | | | 1.24 | | | 0.005 | 19.23 | ○ | ◎ |
| | 65 | | | | | | | | 0.003 | 6.85 | ○ | ○ |
| | 66 | 0.02 | 2.19 | 0.24 | | | | 0.011 | 0.004 | 8.94 | ○ | ○ |
| | 67 | 0.07 | | | | 1.75 | 0.023 | | 0.020 | 29.62 | ○ | ◎ |
| | 68 | 0.05 | 0.50 | 0.09 | 0.22 | | | 0.081 | 0.016 | 10.74 | ○ | ○ |

Note: X value in the table was calculated by the following formula:

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

TABLE 6

| | No. | Ingredients, wt. % | | | | | | | | | | | | |
|---|---|---|---|---|---|---|---|---|---|---|---|---|---|---|
| | | C | Si | Mn | P | S | Al | Cr | W | Nb | V | Ti | Zr | Ta |
| Steel of invention | 69 | 0.018 | 0.18 | 0.22 | 0.020 | 0.007 | 6.60 | 5.4 | 1.48 | | | | | 0.41 |
| | 70 | 0.013 | 1.09 | 1.31 | 0.015 | 0.003 | 5.71 | 5.5 | | | | | 0.18 | 0.05 |
| | 71 | 0.011 | 0.14 | 0.84 | 0.027 | 0.007 | 7.78 | 5.7 | | | | 0.04 | 0.05 | 0.06 |
| | 72 | 0.016 | 0.85 | 0.57 | 0.010 | 0.010 | 4.37 | 6.2 | 0.44 | 0.07 | 0.03 | 0.07 | 0.06 | |
| | 73 | 0.015 | 0.11 | 0.39 | 0.027 | 0.010 | 3.60 | 6.2 | 2.00 | 0.12 | | | 0.08 | |
| | 74 | 0.013 | 0.67 | 0.88 | 0.023 | 0.003 | 7.44 | 6.4 | | | | 0.08 | 0.07 | |
| | 75 | 0.012 | 1.13 | 0.47 | 0.022 | 0.008 | 7.83 | 6.4 | 1.50 | 0.05 | 0.05 | 0.03 | 0.03 | |
| | 76 | 0.013 | 0.12 | 0.74 | 0.024 | 0.009 | 4.72 | 6.7 | 0.20 | | 0.05 | 0.06 | | |

TABLE 6-continued

| No. | Ingredients, wt. % | | | | | | | | | | | | |
|---|---|---|---|---|---|---|---|---|---|---|---|---|---|
| | C | Si | Mn | P | S | Al | Cr | W | Nb | V | Ti | Zr | Ta |
| 77 | 0.004 | 0.06 | 1.46 | 0.030 | 0.004 | 6.62 | 7.3 | | 0.04 | 0.03 | | 0.08 | |
| 78 | 0.013 | 0.74 | 0.46 | 0.019 | 0.005 | 6.87 | 8.1 | | | | | | |
| 79 | 0.012 | 0.20 | 0.38 | 0.027 | 0.003 | 3.57 | 8.2 | | | 0.12 | | | 0.08 |
| 80 | 0.017 | 0.96 | 1.30 | 0.006 | 0.006 | 5.22 | 8.3 | 2.35 | | | 0.11 | 0.08 | |
| 81 | 0.009 | 0.33 | 0.74 | 0.018 | 0.008 | 3.89 | 8.6 | | 0.08 | | 0.05 | | |
| 82 | 0.004 | 0.33 | 0.46 | 0.006 | 0.007 | 4.12 | 8.8 | | | | 0.03 | | |
| 83 | 0.006 | 0.83 | 0.27 | 0.027 | 0.004 | 5.87 | 8.9 | 1.78 | | 0.05 | | | |
| 84 | 0.005 | 1.20 | 0.47 | 0.025 | 0.006 | 6.91 | 9.0 | | 0.18 | | | | |
| 85 | 0.012 | 1.19 | 1.33 | 0.030 | 0.004 | 3.09 | 9.2 | | 0.05 | 0.04 | 0.05 | | 0.04 |
| 86 | 0.007 | 0.39 | 0.80 | 0.013 | 0.007 | 6.01 | 9.5 | 2.22 | | | | 0.18 | |

TABLE 7

(Continuation of Table 6)

| | No. | Ingredients, wt. % | | | | | | | | X value × 10000 | Work-abily | Max. corrosion depth |
|---|---|---|---|---|---|---|---|---|---|---|---|---|
| | | Hf | Cu | Mo | Sb | Ni | Ca | REM | N | | | |
| Steel of invention | 69 | | | | | | | | 0.017 | 1.02 | ○ | ○ |
| | 70 | | | 1.26 | | 0.58 | | | 0.008 | 9.45 | ○ | ○ |
| | 71 | | 1.37 | 1.28 | | 1.79 | | | 0.008 | 5.13 | ○ | ◎ |
| | 72 | 0.08 | 1.21 | 1.12 | 0.18 | 0.32 | | 0.039 | 0.016 | 19.21 | ○ | ◎ |
| | 73 | | | | 0.31 | | | | 0.017 | 1.48 | ○ | ○ |
| | 74 | 0.09 | 0.55 | 0.47 | | | 0.003 | | 0.010 | 14.57 | ○ | ◎ |
| | 75 | | 1.56 | 0.18 | 0.02 | 0.24 | | | 0.018 | 5.34 | ○ | ○ |
| | 76 | 0.07 | 1.72 | 0.32 | 0.14 | | | | 0.011 | 11.16 | ○ | ◎ |
| | 77 | | | | 0.08 | | 0.019 | | 0.007 | 12.36 | ○ | ◎ |
| | 78 | 0.38 | | | | | | | 0.020 | 1.40 | ○ | ◎ |
| | 79 | | 0.46 | | 0.10 | | | | 0.020 | 8.63 | ○ | ○ |
| | 80 | | 0.20 | | | | 0.008 | | 0.019 | 9.92 | ○ | ○ |
| | 81 | | | 1.78 | | | | | 0.005 | 10.08 | ○ | ○ |
| | 82 | | | | | | | | 0.006 | 0.36 | ○ | ○ |
| | 83 | | | | | | | | 0.004 | 3.32 | ○ | ◎ |
| | 84 | 0.08 | | | | | 0.002 | | 0.008 | 16.09 | ○ | ◎ |
| | 85 | 0.02 | 2.79 | 1.70 | 0.08 | 0.45 | 0.015 | 0.030 | 0.015 | 10.03 | ○ | ○ |
| | 86 | | | | | | | | 0.014 | 7.23 | ○ | ○ |

Note: X value in the table was calculated by the following formula:

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

TABLE 8

| | No. | Ingredients, wt. % | | | | | | | | | | | | |
|---|---|---|---|---|---|---|---|---|---|---|---|---|---|---|
| | | C | Si | Mn | P | S | Al | Cr | W | Nb | V | Ti | Zr | Ta |
| Comparative steel | 87 | 0.007 | 0.45 | 1.39 | 0.015 | 0.006 | 0.05 | 2.3 | | | | 0.11 | | |
| | 88 | 0.004 | 0.99 | 0.36 | 0.025 | 0.009 | 0.17 | 7.3 | | 0.12 | | | | |
| | 89 | 0.005 | 0.74 | 1.31 | 0.005 | 0.008 | 0.07 | 7.5 | | | | | 0.16 | |
| | 90 | 0.019 | 0.63 | 1.43 | 0.026 | 0.009 | 0.08 | 9.3 | | | | | | 0.02 |
| | 91 | 0.009 | 0.77 | 0.55 | 0.010 | 0.009 | 0.04 | 5.2 | | | | | | |
| | 92 | 0.007 | 0.48 | 0.59 | 0.011 | 0.008 | 0.11 | 9.8 | | | | | | |
| | 93 | 0.014 | 0.60 | 1.30 | 0.023 | 0.004 | 0.03 | 9.3 | | | | | | |
| | 94 | 0.019 | 0.15 | 0.16 | 0.013 | 0.005 | 0.04 | 8.6 | | | | 0.01 | | |
| | 95 | 0.014 | 0.96 | 1.38 | 0.027 | 0.004 | 0.03 | 9.2 | | | | | | |
| | 96 | 0.014 | 0.96 | 1.21 | 0.021 | 0.007 | 0.03 | 9.1 | | 0.02 | | | 0.01 | |
| | 97 | 0.008 | 1.04 | 0.89 | 0.026 | 0.005 | 0.03 | 11.5 | | | | 0.15 | | |
| | 98 | 0.013 | 0.49 | 0.40 | 0.015 | 0.004 | 0.11 | 12.1 | 0.15 | 0.15 | 0.05 | | | |

TABLE 9

(Continuation of Table 8)

| | No. | Ingredients, wt. % Hf | Cu | Mo | Sb | Ni | Ca | REM | N | X value × 10000 | Workability | Max. corrosion depth |
|---|---|---|---|---|---|---|---|---|---|---|---|---|
| Comparative steel | 87 | | | | | | | | 0.012 | 11.45 | ○ | X |
| | 88 | | | | | | | | 0.014 | 2.02 | ○ | X |
| | 89 | | | | | | | | 0.019 | 3.50 | ○ | X |
| | 90 | | | | | | | | 0.014 | −19.69 | X | X |
| | 91 | 0.02 | | | | | | 0.032 | 0.010 | −10.34 | X | X |
| | 92 | | | | | | 0.003 | | 0.020 | −15.79 | X | X |
| | 93 | | | 1.50 | | | | | 0.017 | −19.59 | X | X |
| | 94 | | | | 0.41 | | | | 0.008 | −15.18 | X | X |
| | 95 | | 1.10 | | | | | | 0.017 | −19.09 | X | X |
| | 96 | | | | | 1.80 | | | 0.005 | −9.23 | X | X |
| | 97 | 0.01 | 0.05 | | | | | | 0.006 | 22.67 | ○ | X |
| | 98 | | 0.40 | | | | | | 0.018 | 6.55 | ○ | X |

Note: X value in the table was calculated by the following formula:

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

[Industrial Applicability]

As is apparent from the above example, the present invention provides a steel having excellent corrosion resistance in an exhaust system of an internal combustion engine in automobiles and the like or a steel having excellent corrosion resistance and workability at low cost and, hence, can greatly contribute to the development of industries.

We claim:

1. A steel having excellent corrosion resistance, characterized by comprising by weight Si: not less than 0.01 to less than 1.2%, Mn: 0.1 to 1.5%, Cr: 3.5 to less than 6.0%, and Al: more than 3.0 to 4.3%, and, other elements with the following upper limits:

C: not more than 0.02%,

P: not more than 0.03%,

S: not more than 0.01%, and

N: not more than 0.02%, with the balance consisting of Fe and unavoidable impurities.

2. The steel having excellent corrosion resistance according to claim 1, which further comprises as an additional ingredient at least one member selected from, by weight, Cu: 0.05 to 3.0%, Mo: 0.05 to 2.0%, Sb: 0.01 to 0.5%, Ni: 6.01 to 2.0%, and W: 0.05 to 3.0%.

3. The steel having excellent corrosion resistance according to claim 1, which further comprises as an additional ingredient at least one member selected from, by weight, rare earth element: 0.001 to 0.1%, and Ca: 0.0005 to 0.03%.

4. A steel having excellent corrosion resistance and workability, characterized by comprising by weight Si: not less than 0.01 to less than 1.2%, Mn: 0.1 to 1.5%, Cr: 3.5 to less than 6.0%, and Al: more than 3.0 to 4.3%, and, C: not more than 0.02%, P: not more than 0.03%, S: not mere than 0.01%, and N: not more than 0.02%, and 0.01 to 0.5% in total of at least one element selected from Nb, V, Ti, Zr, Ta, and Hf, provided that a requirement represented by the following formula is met:

$$\frac{Nb}{93}+\frac{V}{51}+\frac{Ti}{48}+\frac{Zr}{91}+\frac{Ta}{181}+\frac{Hf}{179}-0.8\times\left[\frac{C}{12}+\frac{N}{14}\right]\geqq 0$$

with the balance consisting of Fe and unavoidable impurities.

5. The steel having excellent corrosion resistance and workability according to claim 4, which further comprises as an additional ingredient at least one member selected from, by weight, Cu: 0.05 to 3.0%, Mo: 0.05 to 2.0%, Sb: 0.01 to 0.5%, Ni: 0.01 to 2.0%, and W: 0.05 to 3.0%.

6. The steel having excellent corrosion resistance and workability according to claim 4, which further comprises as an additional ingredient at least one member selected from, by weight, rare earth element: 0.001 to 0.1%, and Ca: 0.0005 to 0.03%.

* * * * *

UNITED STATES PATENT AND TRADEMARK OFFICE

CERTIFICATE OF CORRECTION

PATENT NO. : 5,720,920

DATED : February 24, 1998

INVENTOR(S) : Kenji KATO, et al.

It is certified that error appears in the above-indentified patent and that said Letters Patent is hereby corrected as shown below:

Column 1, line 44, change "examples," to --example,--.

Column 1, line 54, change "improving" to --improve--.

Column 3, line 54, change "Fin" to --Mn--.

Column 4, line 34, change "element" to --elements--.

Column 4, line 64, change "anal" to --an Al--.

Column 5, line 15, change "anal" to --an Al--.

Column 8, table 2, line 31, change "O" to --θ--.

Column 10, table 5, heading of next to last column should be changed from "Workabily" to --Workability--.

Column 12, table 7, heading of next to last column should be changed from "Workabily" to --Workability--.

Column 14, table 9, heading of next to last column should be changed from "Workabily" to --Workability--.

UNITED STATES PATENT AND TRADEMARK OFFICE

CERTIFICATE OF CORRECTION

PATENT NO. : 5,720,920
DATED : February 24, 1998
INVENTOR(S) : Kenji KATO, et al.

It is certified that error appears in the above-indentified patent and that said Letters Patent is hereby corrected as shown below:

Column 13, line 54, change "6.01" to --0.01--.

Column 14, line 32, change "mere" to --more--.

Signed and Sealed this

Twenty-second Day of September, 1998

*Attest:*

Bruce Lehman

BRUCE LEHMAN

*Attesting Officer*

*Commissioner of Patents and Trademarks*